US005601463A

United States Patent [19]

Kobelt

[11] Patent Number: 5,601,463

[45] Date of Patent: Feb. 11, 1997

[54] FLUID ACTUATED CYLINDER WITH OUTBOARD MOTOR MOUNTING

[76] Inventor: Jacob Kobelt, 1654 Ocean Park Road, Surrey, British Columbia, Canada, V4A 4V5

[21] Appl. No.: 494,788

[22] Filed: Jun. 26, 1995

[51] Int. Cl.[6] ..... B63H 5/12

[52] U.S. Cl. ..... 440/61; 114/150

[58] Field of Search ..... 248/640–643; 440/53, 56, 59, 61, 62, 63, 65, 900; 114/150, 144 R

[56] References Cited

U.S. PATENT DOCUMENTS

| | | | |
|---|---|---|---|
| 4,482,330 | 11/1984 | Cook | 440/61 |
| 4,687,448 | 8/1987 | Peirce | 440/61 |
| 4,731,035 | 3/1988 | Wagner | 440/61 |
| 4,773,882 | 9/1988 | Rump | 440/61 |
| 4,836,812 | 6/1989 | Griffiths | 440/61 |
| 5,002,510 | 3/1991 | Rump | 440/61 |
| 5,092,801 | 3/1992 | McBeth | 440/61 |
| 5,127,856 | 7/1992 | Kabuto et al. | 440/60 |
| 5,213,527 | 5/1993 | Fetchko | 440/61 |
| 5,328,394 | 7/1994 | Onoue et al. | 114/150 |

FOREIGN PATENT DOCUMENTS 3910891 4/1989 Germany .

*Primary Examiner*—Stephen Avila
*Attorney, Agent, or Firm*—Bull, Housser & Tupper

[57] ABSTRACT

A fluid cylinder steering apparatus is for mounting on a marine outboard motor for swivelling the motor for steering, and provides a simplified connection between the steering cylinder and the tiller. The steering cylinder comprises a tubular body portion, a piston rod and piston reciprocable axially within the body portion, and a pair of end caps enclosing respective open end portions of the body portion. Each end cap has a cap boss with a cap fastener opening to receive a bracket fastener and a piston rod opening to receive the piston rod. Retainers cooperate with the end caps to retain the end caps on the body portion. A mounting bracket includes a bracket body portion and a pair of bracket bosses extending therefrom. The bracket body portion has an array of openings to facilitate securing the bracket to an outboard motor. Several openings of the array of openings which are aligned with a pattern of existing openings of the motor and accept fasteners therein. The array of openings simplifies connection to different patterns of existing opening provided in outboard motors by different manufacturers. Each bracket boss has a respective bracket fastener opening which cooperates with a respective cap boss and the respective bracket fastener to secure the mounting bracket to end caps of the cylinder.

20 Claims, 5 Drawing Sheets

FLUID ACTUATED CYLINDER WITH OUTBOARD MOTOR MOUNTING

BACKGROUND OF THE INVENTION

The invention relates to a fluid actuated steering apparatus, particularly for use with an outboard motor on a marine vessel.

Outboard motors are a common form of propulsion for many marine vessels, and while direct mechanical steering is practical for low powered units, hydraulic steering is necessary for more powerful units.

All outboard motors have a generally vertical leg carrying a propeller, the leg being rotatable about a generally vertical axis which correspondingly swivels the propeller for steering, the axis being referred to as a steering axis. Commonly, hydraulic steering is effected by a hydraulic cylinder mounted generally transversely of a longitudinal axis of the vessel, the cylinder cooperating with a tiller arm so that actuation of the cylinder swivels the motor and propeller about the generally vertical axis to control steering.

In addition, most outboard motors are mounted for limited rotation about a generally horizontal axis, commonly called a tilt axis, by journalling the motor on a tilt rod or tilt tube. In this way the motor can be tilted between a lowered position thereof, in which the propeller is immersed in the water for propulsion, and a raised position in which the propeller can be positioned above the water for stowage, or partially lowered intermediate positions for use when the boat is in shallow or obstructed waters.

Several different arrangements of the hydraulic cylinder are possible, and in one common arrangement opposite ends of a piston rod of the steering cylinder are secured by linkages to opposite ends of a tilt rod or tilt tube. Such an arrangement has provisions for connecting the tiller to a portion of the steering cylinder to follow tilting movement of the outboard motor as it tilts between lowered and raised positions.

Two recent patents showing an arrangement of a horizontally disposed steering cylinder are U.S. Pat. Nos. 5,002,510 (inventor-Martin Rump) and 5,092,801 (inventor-James McBeth). Both of these structures show means for the tiller connection to accommodate tilting of the motor between the raised and lowered positions, which means are relatively complex and/or tend to introduce excessive lost motion into the connection. Other patents show alternative means of connecting the steering cylinder to the outboard motor, for example U.S. Pat. Nos. 4,773,882 (Inventor—Martin Rump) and 4,731,035 (Inventor—William Wagner).

In applicant's opinion, many of the tiller/cylinder connections in the prior art can be costly to manufacture and maintain, and can also present problems during installation of the steering apparatus.

SUMMARY OF THE INVENTION

The invention reduces the difficulties and disadvantages of the prior art by providing a fluid cylinder steering apparatus which provides a simple connection between the steering cylinder, the tiller, and the outboard motor itself to enable swivelling of the motor about the steering axis for steering, and tilting of the motor about the tilt axis between the operative and inoperative positions. In addition, portions of the connection can be fabricated at relatively low cost by die-casting to produce sturdy one-piece end caps with the integral brackets or bosses which permit easy connection to a wide variety of outboard motors. Common problems associated with porosity which are usually found in die-castings are essentially overcome by a sealing structure according to the invention.

The apparatus comprises a steering cylinder having a tubular body portion, a piston rod and piston, first and second end caps, and retainers. The apparatus also includes a mounting bracket to be secured to the cylinder and to an outboard motor mount. The tubular body portion has a bore disposed about a cylinder axis and first and second open end portions. The piston rod and piston are moveable axially relative to the bore of the body portion. The first and second end caps enclose the first and second open end portions of the body portion respectively. Each end cap has a cap boss with a respective cap fastener opening and an axially disposed piston rod opening to receive the piston rod passing therethrough. The retainers cooperate with the end caps to retain the end caps on the body portion. The mounting bracket includes a bracket body portion and a pair of bracket bosses extending therefrom. Each bracket boss has a respective bracket fastening opening and is located to cooperate with a respective cap boss to form a pair of aligned fastener openings. A boss fastener cooperates with each pair of aligned fastener openings to secure the mounting bracket to the end caps of the steering cylinder, the bracket body portion being adapted to be secured to the outboard motor mount.

Preferably, each cap boss has a mounting face containing the cap fastener opening, and each bracket boss has a mounting face containing the respective bracket fastener opening. The mounting face of the bracket boss and the mounting face of the cap boss are generally complementary to each other to provide a secure fit therebetween. In one embodiment, the mounting face of each bracket boss, and the mounting face of each cap boss are within planes disposed generally perpendicularly to the cylinder axis. In this said one embodiment, the fastener openings of the cap bosses and the bracket bosses are mutually aligned with each other on a boss fastener axis disposed parallel to the cylinder axis. In an alternative embodiment, the mounting face of each bracket boss, and the mounting face of each cap boss are within a plane disposed generally parallel to the cylinder axis. In this alternative, the fastener openings of the cap boss and the bracket boss of each pair of cap bosses and bracket bosses are disposed parallel to each other and perpendicularly to the cylinder axis.

A detailed disclosure following, related to drawings, describes embodiments of the invention which are capable of expression in structure other than that particulary described and illustrated.

DETAILED DESCRIPTION

Figure 1:
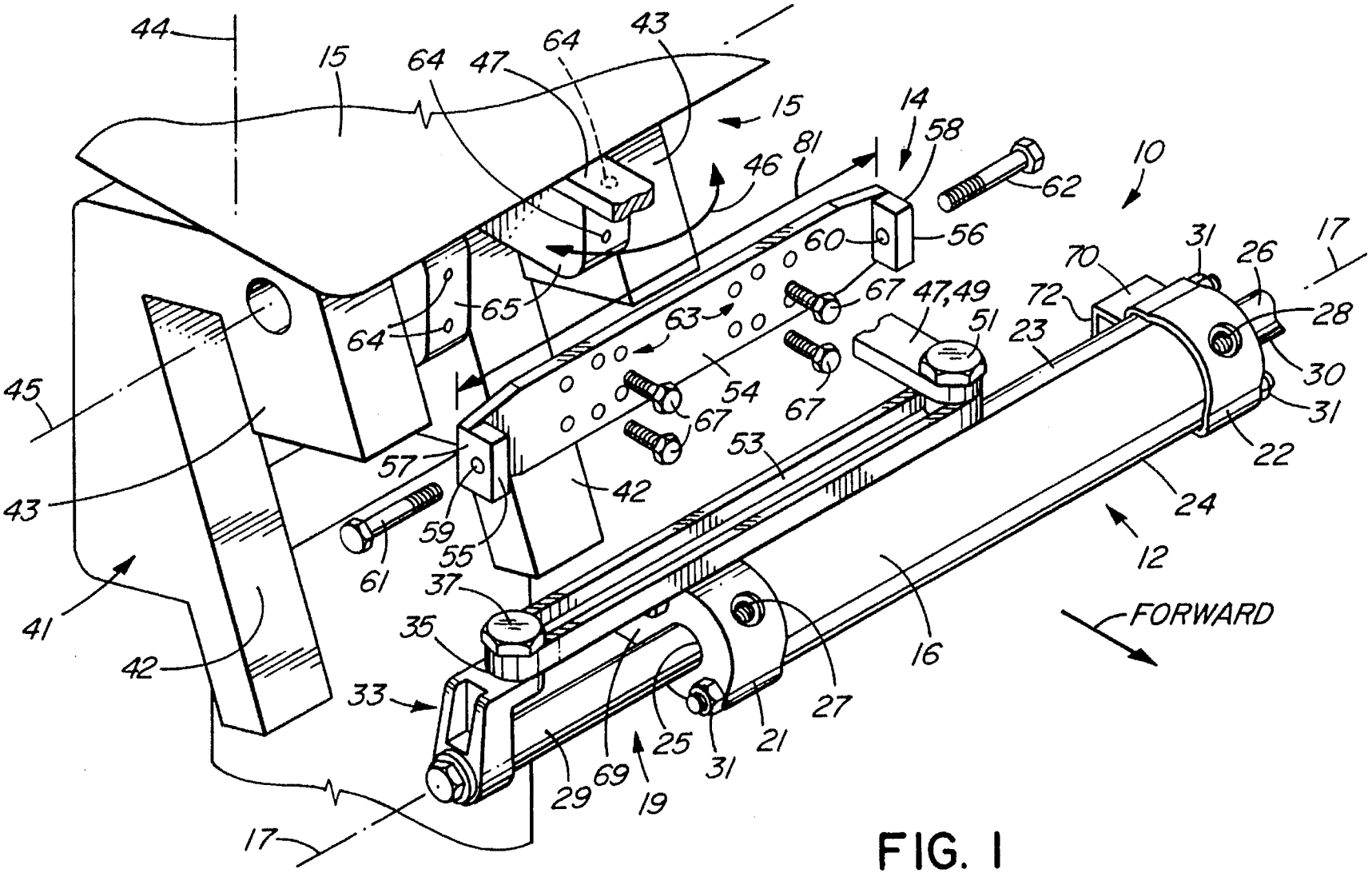
FIG. 1 is a simplified, fragmented exploded perspective of a steering cylinder and mounting bracket according to the invention, shown cooperating with a marine outboard motor, some important fasteners being shown.
Figure 2:
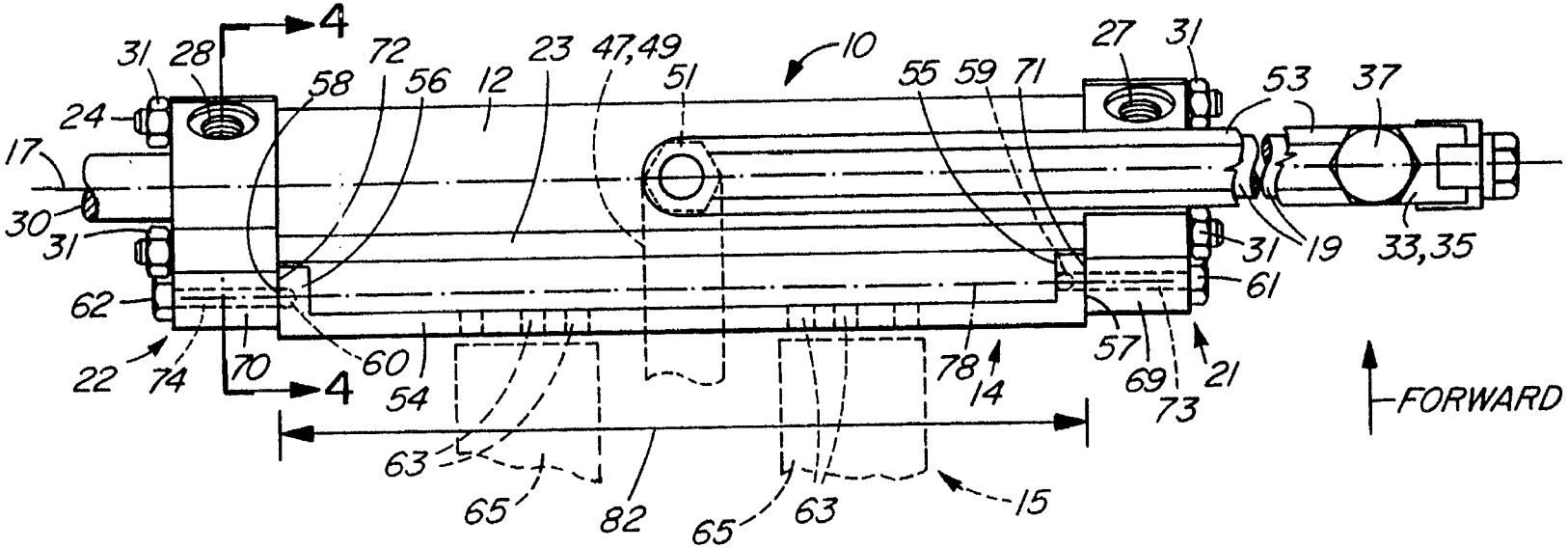
FIG. 2 is a simplified, fragmented top plan view of a cylinder and mounting bracket assembly, also showing some associated structure.
Figure 3:
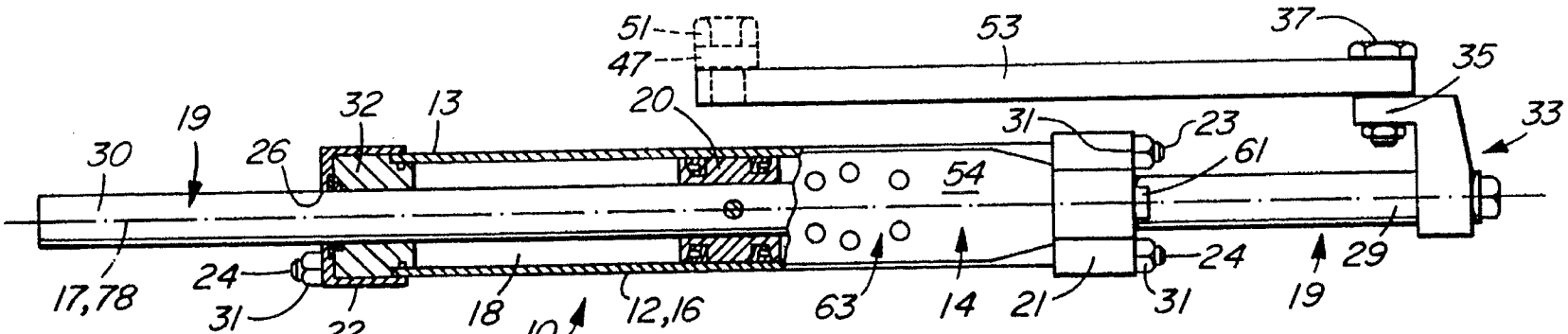
FIG. 3 is a simplified, fragmented rear elevation, partially in section of the assembly of FIG. 2, as seen looking forward.

FIGS. 1 to 3

As best seen in FIG. 1, a fluid cylinder steering apparatus 10 according to the invention comprises a fluid steering cylinder 12 and a mounting bracket 14, the bracket being an intermediate connection to secure the cylinder to a conventional outboard motor 15. The steering cylinder 12 includes a tubular body portion 16 having a central bore 18 with similar first and second open end portions, the second open end portion 13 only being shown in FIG. 3. The bore 18 of the cylinder is disposed about a longitudinal cylinder axis 17, and the cylinder has a piston rod 19 extending along the axis and carrying a piston 20, the rod and piston being reciprocable axially relative to the body portion.

The cylinder 12 also includes first and second end caps and 22 enclosing the first and second open end portions of the body portion respectively and being retained in place by a pair of conventional tie bars, hereinafter termed first and second retaining bars 23 and 24 as will be described. Threaded nuts 31 are fitted on threaded end portions of the retaining bars 23 and 24 to secure the end caps thereto as is conventional practice. The first and second end caps 21 and 22 are mirror images of each other and have axially disposed first and second piston rod openings 25 and 26 respectively to receive first and second end portions 29 and 30 respectively of the piston rod passing therethrough. The first and second end caps 21 and 22 also have first and second fluid ports 27 and 28 respectively which are adapted to receive fluid couplings to transmit fluid relative to the cylinder as will be described with reference to FIGS. 4 through 8. As seen only in FIG. 3, the second end cap 22 encloses an end plug 32 fitted adjacent the second open end portion 13 so as to partially close the open end portion and is retained thereon by the end cap as will be described. For consistency of terminology, the end plug 32 is termed a second end plug and a first end plug, not shown, is fitted within the first end cap 21 and is a mirror image of the second end plug and thus is not described. The first end portion 29 of the rod carries a drag link bracket 33 which has a boss 35 displaced laterally therefrom and carrying a bolt 37.

The outboard motor 15 has a conventional mounting clamp assembly 41 adapted to clamp onto a transom of the vessel, not shown. The mounting clamp assembly 41 includes a pair of parallel, generally vertically extending aft supports 42 which engage an aft face of the transom, and a pair of generally complementary forward supports 43 which are positioned forwardly of a forward face of the transom and carry conventional clamping structures, not shown, for securing the clamp assembly 41 to the transom as is well known. The outboard motor 15 is journalled for rotation with respect to the mounting clamp assembly 41 about a generally horizontal tilt axis 45 to permit aftwards tilting of a steering leg and associated propeller, not shown, to accommodate shallow water and other operational requirements. The outboard motor also has a tiller arm 47 extending forwardly therefrom to permit an operator or steering mechanism to swing the tiller arm to rotate the motor about a generally vertical steering axis 44 so as to swivel the steering leg and the propeller to effect steering. For hydraulic steering, the tiller arm 47 has an outer end 49 which carries a bolt 51, and a drag link 53 extends between the bolt 51 and the bolt 37 of the bracket 33 to connect the tiller to the piston rod. Thus, it can be seen that axial movement of the piston rod 19 with respect to the cylinder 12 moves the drag link 53 which swings the tiller arm 47 about the vertical steering axis 44 per arrow 46, to effect steering by swivelling the motor and propeller.

The mounting bracket 14 has a bracket body portion 54 and first and second bracket bosses 55 and 56 extending laterally from the bracket body portion and forwardly towards the cylinder axis. The bracket body portion is a flat, elongated plate and the bracket bosses comprise relatively widely spaced apart flanges extending generally perpendicularly from the body portion. The bracket bosses have respective mounting faces 57 and 58 with bracket fastener opening 59 and 60 extending therethrough and being screw threaded to receive aligned bracket fasteners 61 and 62 as shown. The bracket body portion 54 is a flat elongated plate with an array 63 of openings arranged so as to be alignable with a pattern of at least four motor fastener openings 64 provided on a pair of connectors 65 extending forwardly from the outboard motor, one opening being shown in broken line. Four motor fasteners 67, e.g. bolts, can pass through four appropriate openings of the array 63 which are aligned with the four openings 64 so as to secure the bracket 14 to the connectors 65 of the outboard motor.

The pattern of motor fastener opening 64 varies from manufacturer to manufacturer of outboard motors, and usually about four of these openings receive bolts or other fasteners and are used to provide a temporary restraint for the motor when it is shipped in a container from the manufacturer to the distributor or installer, etc. Normally, a light bracket, not shown, having the appropriate pattern of openings is fastened to the connectors 65 with fasteners passing through the openings 64, and the bracket is also secured to the container carrying the outboard motor so as to restrain the motor from undesirable movement within the container. The openings 64 used temporarily in the prior art to facilitate shipping are used herein to provide a permanent and convenient mount for the bracket 14 to enable the cylinder to be secured thereto. In order to accommodate the various patterns of the openings 64 used by different manufacturers, the bracket body portion 54 has the array of openings 63 in which at least four openings of the array can be aligned with the opening 64 or equivalents.

Figure 5:
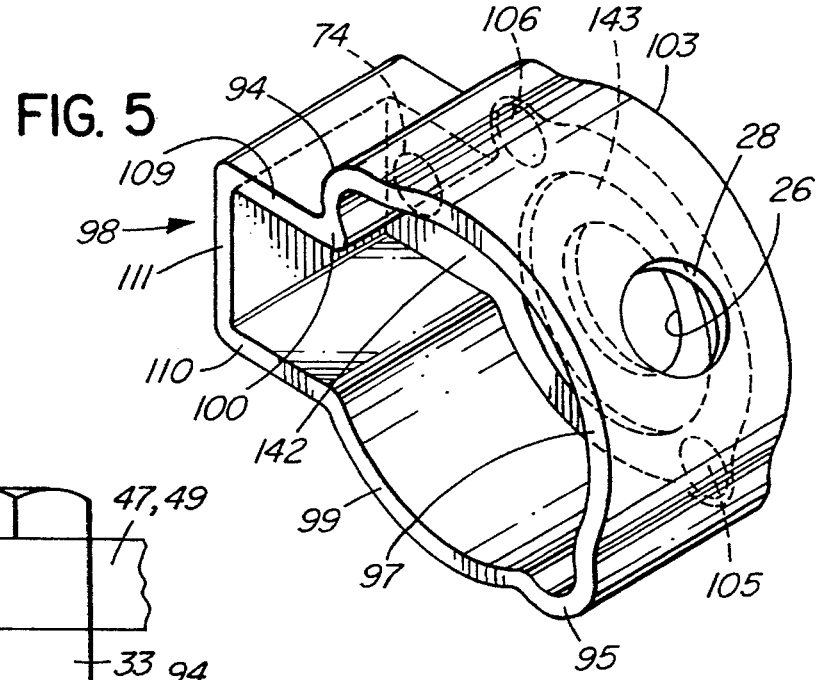
FIG. 5 is a simplified, perspective of an end cap according to the invention, shown isolated from associated structure.

The first and second end caps 21 and 22 of the cylinder have first and second cap bosses 69 and 70 with mounting faces 71 and 72 respectively containing cap fastener openings 73 and 74 respectively. As partially seen in the FIG. 1, and as best seen in FIG. 5, the mounting faces 71 and 72 of the end caps are defined by relatively thin end faces of die-cast walls, typically about 3 mms. thick extending around an opening. A portion of the opening is complementary to the body portion 16, and the walls enclose the respective open end portion of the body portion 16. Each cap boss extends laterally and outwardly from the respective end cap, and away from the cylinder axis. In contrast, the mounting faces 57 and 58 of the bracket bosses 55 and 56 are generally flat, with the openings 59 and 60 to receive the fasteners, and thus engage the end face of the walls of the mounting faces to provide a sturdy connection therewith. Thus, the mounting faces of the bracket bosses and the mounting faces of the cap bosses are, in effect, complementary to each other, i.e. they fit together, and are within respective undesignated planes disposed generally perpendicularly to the cylinder axis.

When the cylinder 12 and the bracket 14 are assembled as shown in FIGS. 2 and 3, the fastener openings 73 and 74 of the cap bosses 69 and 70, and the fastener openings 59 and 60 of the bracket bosses 55 and 56 are mutually aligned with each other on a boss fastener axis 78 disposed parallel to the cylinder axis 17. The fasteners 61 and 62 pass through fastener openings 73 and 59, and 74 and 60 respectively so as to secure the bracket bosses to the end caps. As will be described with reference to FIGS. 4 and 5, because the end caps are die-cast, walls of the end caps have an essentially constant thickness throughout. Thus when the fasteners 61 and 62 pass through the respective cap fastener openings 73 and 74, outer threaded ends of the fasteners can be easily moved laterally to accommodate alignment of the openings 59 and 60 so that the threaded ends thereof can engage the threaded fastener openings 59 and 60 in the brackets. Clearly, as best seen in FIGS. 1 and 2, axial spacing 81 between the mounting faces 57 and 58 of the bracket bosses is less than axial spacing 82 between the mounting faces 71 and 72 of the cap bosses to permit the mounting bracket to be interposed between the end caps.

The difference in the spacings 81 and 82 is preferably relatively small so that the bracket 14 is a snug fit between the bosses 69 and 70, thus eliminating any lost motion that might otherwise occur. Alternatively, shims can be used to reduce or eliminate lost motion or undesirable stresses resulting from accumulation of tolerances between the cylinder end caps and the bracket. The bracket 14 is thus securely located with respect to the cylinder relatively independently of tightening forces from the bracket fasteners, and in contrast to some prior art structures, excessive forces on the steering system that can occur in heavy seas are unlikely to cause inadvertent relative movement between the bracket and the bosses. Clearly, location of the cap bosses is dependent entirely on location of the end caps, which in turn is controlled by the retainer bars 23 and 24 and associated nuts which are sturdy and provide adequate restraint against inadvertent movement.

In addition, mounting of the cylinder 12 on the bracket 14 using the two fasteners 61 and 62 provides a convenient means of adjusting relative positions of the cylinder 12 and the tiller arm 47 as follows.

To reduce oblique or twisting forces on the tiller during actuation of the cylinder, it is important that the drag link 53 moves within a plane disposed generally perpendicularly to the steering axis 44. This is attained by rotatably adjusting the orientation of the cylinder 12 with respect to the tiller by rotating the cylinder about the boss fastener axis 78. This adjustment is easily accomplished when first connecting the cylinder to the bracket 14 by loosening the fasteners 61 and 62, setting the cylinder in the correct orientation so that the drag link 40 reciprocates with the cylinder in a plane generally perpendicular to the axis 44, after which the fasteners 61 and 62 are tightened to prevent further movement. Thus, by providing the mounting faces of each bracket boss and each cap boss within planes disposed generally perpendicularly to the cylinder axis, and having fastener openings mutually aligned with each other and disposed parallel to the cylinder axis, easy adjustment of the cylinder with respect to the tiller arm is attained, while providing a sturdy connection in which any lost motion and bolt tightening problems are essentially eliminated.

Figure 4:
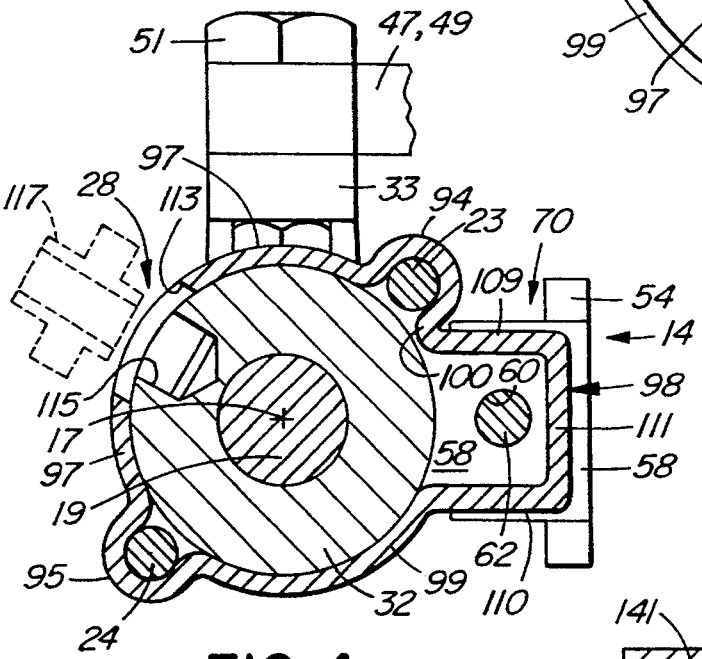
FIG. 4 is a simplified, fragmented cross section on line 4—4 of FIG. 2, showing cooperation between the steering cylinder and the mounting bracket.

FIGS. 4 and 5

The first end cap 22 resembles an open-ended cup and has diametrically opposed, first and second arcuate wall portions 94 and 95 which are inter-connected by a semi-cylindrical wall portion 97, a generally U-sectioned wall portion 98, a partially cylindrical wall portion 99, and a relatively sharp V-shaped portion 100 to form a continuous peripheral wall to enclose the body portion b6. The U-sectioned wall portion 98 is generally square cornered and is separated from the first arcuate wall portion 94 by the relatively sharp V-shaped wall portion 100.

The end cap has an end wall portion 103 which is integral with coplanar outer edge portions of the wall portions 97, 98, 99 and 100, and is generally flat and provided with the first piston rod opening 25. The end wall portion 103 also has a pair of diametrically oppositely located bar openings 105 and 106 adjacent the wall portions 94 and 95 respectively to receive ends of the first and second retaining bars 23 and 24 respectively (see FIG. 3) passing therethrough. When assembled, the end caps are arranged so that the bar openings of the first end cap are aligned with corresponding bar openings of the second end cap. The pair of axially disposed retaining bars or tie rods 23 and 24 are disposed parallel to the cylindrical body portion and, as described, have respective threaded end portions passing through the aligned bar openings of the end caps to receive the nuts 31 (FIG. 3) to retain the caps on the end portions. Thus, the bar openings, retaining bars and nuts serve as retainers cooperating with the end caps to retain the end caps on the body portion. Other means of securing the end caps to the body portion are envisaged, such as screw threads, snap rings in complementary grooves, etc., and all such means serve as retainers to retain the end caps on the body portion.

The U-sectioned wall portion 98 is a portion of a square and has a pair of generally parallel inner wall portions 109 and 110 and a outer wall portion 111 disposed perpendicularly thereto. The portion 111 is also generally parallel to a theoretical tangent to the cylindrical surface of the end plug 32 but this is not necessary. A portion of the end wall portion 103 is enclosed by the wall portions 109, 110 and 111 and contains the cap fastener opening 74 to receive the bracket fastener 62. It can be seen that the wall portions 109, 110 and 111 of the U-sectioned wall portion 98 form a partially square U-sectioned wall portion which functions primarily as the cap boss 70 to provide a rugged connection for the bracket. Each bracket boss has a respective bracket fastener opening and is located to cooperate with a respective cap boss to form a pair of aligned fastener openings. The boss fastener cooperates with each pair of aligned fastener opening to secure the mounting bracket to the end caps of the steering cylinder.

It can be seen that the end cap 22 is a relatively compact and sturdy integral or one piece item, and that the arcuate wall portions 94 and 95 closely enclose or embrace the retaining bars 23 and 24 respectively. The bars thus cooperate with the end caps to provide relatively long axial contact between the end caps and the retaining bars. Also, the arcuate wall portions closely enclose the respective end plug to further increased rigidity of connections between adjacent components, and the wall portions 94 and 95 hold the retainer bars 23 and 24 closely adjacent the body portion 16 of the cylinder, thus reducing the space required for installation and providing a compact and rigid unit. Thus, the close contact and relatively long axial contact between the wall portions of the end cap, the end plug, the body portion, and the retaining bars assist in resisting any twisting previously imposed on the end cap by the mounting bracket 14 due to axial or oblique forces from the drag link. In contrast with functionally similar prior art structure, the bosses and associated end caps are integral with each other, and are securely retained by the retainer bars, and this secure connection essentially prevents inadvertent displacement between the bosses and the tubular body portion 16. Some prior art connections between steering cylinders and outboard motors comprise several components which are prone to loosening or distortion which causes malfunction or service problems. For example, in some prior art devices brackets are clamped to body portions of cylinders in which the bracket relies on friction to locate it in a desired location. If there is any slippage between the bracket and the cylinder, the clamps are tightened, which can result in distortion of the cylinder, detracting from cylinder performance.

In summary, the retaining bars secure the end caps and integral bosses adjacent to the ends of the cylinder body and to the end plugs by applying an axial compressive force. The retaining bars also stiffen the connections of the bosses to the body portion to resist any relative movement between a boss and a respective cylinder due to oblique forces. The wall portions 94 and 95 thus serve as bar embracers to embrace adjacent portions of the bars on opposite sides of the cylinder body so that a particular portion of each bar passes closely between the end cap and the body portion. Clearly, the bar embracers of each end cap are aligned axially with respect to the respective bar openings. The U-sectioned wall portion 98 provides a sturdy boss for cooperation with the mounting bracket 14 and, in combination with a similar end cap at the opposite end of the cylinder securely locates the bracket 14 with respect to the cylinder.

As previously stated, for manufacturing convenience, the end caps 21 and 22 are die-cast using a suitably corrosion resistant and strong material, e.g. phosphor bronze. While such material has excellent corrosion resistance and die-casting qualities, some die-castings are commonly slightly porous to hydraulic fluid under pressure, especially where the castings have been machined to remove the casting "skin". Porosity causes the castings to "weep" the pressurized hydraulic fluid, which is unsatisfactory for most applications. The present invention provides a sealing structure which isolates the die-cast material of the end cap from hydraulic fluid under pressure by interposing a sealed, non-porous material between the pressurized fluid and the end cap. This sealing is attained by use of the end second plug 32, (and the equivalent first end plug at the first end portion) the body portion 16, and suitable seals as will be described with reference to FIGS. 6 through 8. Because the body portion 16 and the end plugs are exposed to hydraulic fluid, they are made of non-porous material which is formed or machined from solid stock material so as not to "weep" hydraulic fluid when under pressure. In addition, it is noted that the end cap is of simple design for die casting that requires negligible machining after casting, thus further reducing tooling costs and unit costs.

Also, as seen in FIG. 4, the second fluid port 28 comprises a transverse clearance opening 113 in the semi-cylindrical wall portion 97 of the end cap 22, and a threaded radial opening 115 in the end plug 32. The two openings are aligned so that a threaded fluid supply coupling 117, shown in broken outline, can pass through the opening 113 without interference, and engage threads in the opening 115 so as to supply fluid to the end plug 21 through flexible hoses, not shown. Thus, the end cap associated with a particular end plug has the transverse opening 113 passing therethrough, which is aligned with the radial threaded opening in the end plug to communicate with the fluid conduit or coupling to conduct fluid through the conduit to communicate with the bore of the body portion as will be described with reference to FIGS. 6 through 8.

FIGS. 5 through 8

Figure 6:
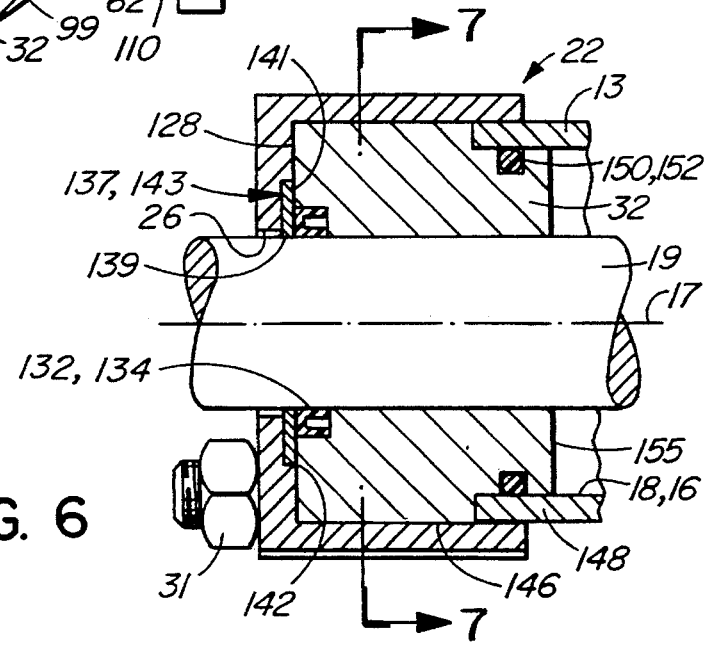
FIG. 6 is a simplified, fragmented longitudinal cross section of an end cap and structure associated with an end of the steering cylinder and is similar to a portion of FIG. 3.

Referring to FIG. 6, the second end plug 32 has an annular, generally flat outer surface 128 disposed perpendicularly to the cylinder axis 17 and containing a seal groove 132 extending around a rod opening 133 of the plug which is aligned with the rod opening 26 of the end cap 22. An annular seal, for example a cup seal 134, is fitted in the seal groove 132 and sealably engages the rod 19 so as to prevent fluid leaking along the rod. A flat washer 137 has a relatively close fitting clearance opening 139 to receive the piston rod 19 passing therethrough, and has a flat inner surface 131 which engages the annular seal 134 and the outer surface 128 of the second end plug. An inner surface 142 of the end wall portion 103 of the cap 21 has a shallow annular groove 143 (also see FIG. 5), the groove being concentric with the piston rod opening 26 and having a diameter to receive the flat washer 137 therein. The groove 143 has a depth which is less than thickness of the washer 137 so that the washer protrudes slightly from the inner surface 142 to ensure that an outer face of the washer 137 contacts the surface 142 so that an inner face of the washer is urged against the seal 134 and the outer surface 128 of the end plug. This leaves a small annular shaped clearance between the surfaces 128 and 142 extending around the washer 137. Thus, the flat washer 137 is sandwiched between the groove 143 of the end cap and the outer surface 128 of the end plug by force from the retaining bars, and ensures that the cup seal 134 remains in place to provide an effective seal against the piston rod.

Figure 8:
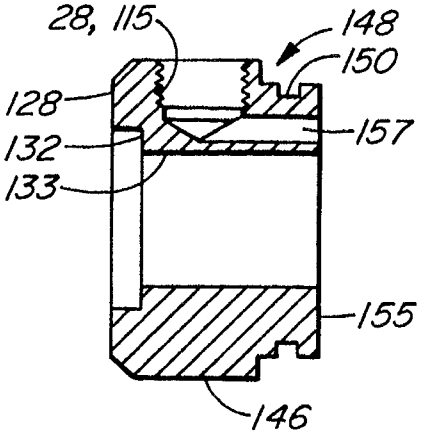
FIG. 8 is a simplified, longitudinal section of an end plug only, as would be seen from line 8—8 of FIG. 7.

As seen in FIG. 8, the end plug 32 has a cylindrical surface 146 which is a snug fit within the end cap 22. An inner portion of the surface 146 has an annular recessed portion 148, the recessed portion being of essentially the same diameter as the bore 18 of the body portion 16 to receive the first open end portion 13 of the body portion thereon. The recessed portion 148 has an annular seal groove 150 therein which receives an annular seal, for example an O-ring seal 152, the O-ring seal sealing a gap between the first open end portion 13 of the body portion 16 and the end plug 22.

Figure 7:
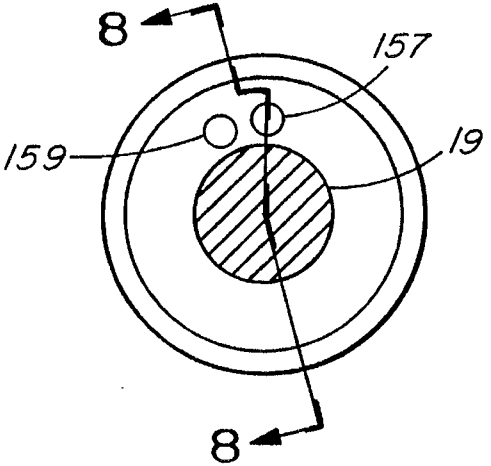
FIG. 7 is a simplified, fragmented cross-section on line 7—7 of FIG. 6.

As best seen in FIGS. 7 and 8, the end plug 32 has a flat, annular inner surface 155 exposed to the bore 18 of the body portion, and a first transfer conduit 157 extends inwardly from the surface 155 to communicate with the threaded radial opening 115, which in turns communicates with the first fluid port 27. A second similar transfer conduit 159 also communicates with the opening 115 and extends parallel to the first transfer conduit 157 and thus doubles capacity of the flow between the fluid coupling and the bore 18 of the body portion.

As previously stated, the first end cap 21 and related first end plug are mirror images of the second end cap 22 and the second end plug 32 and function equivalently.

Thus, the first and second end plugs sealingly engage the first and second open end portions respectively of the body portion and are partially enclosed by the first and second end caps respectively and are of a non-porous material. Each end plug has a piston rod opening therein to receive the piston rod passing therethrough, each rod opening being aligned with a respective axially disposed piston opening of the respective end cap and being sealed against the piston rod to prevent fluid leaking therefrom.

OPERATION

It can be seen that the steering cylinder is mounted directly on the outboard motor 15 with a simple hinged connection between the drag link of the cylinder and the tiller arm. Thus, as the outboard motor is tilted about the axis 45 between raised and lowered positions thereof, the steering cylinder moves bodily with the motor. The simple hinge connection between the drag link and tiller arm also moves with the motor and thus is not subjected to any adverse loadings or oblique loadings that can occur in some prior art structure where the steering cylinder is fixed relative to the vessel, and the connection between the tiller arm and the steering cylinder accommodates the tilting of the outboard motor between the raised and lowered positions thereof. This results in a simple and rugged structure which can be manufactured for relatively little cost, and reduces manufacturing and maintenance problems when compared with many of the prior art structures known to the inventor.

Operation of the apparatus 10 closely follows the operation of prior art hydraulic steering cylinders. Clearly, pressurized supply fluid is fed into one of the ports 27 or 28 from a helm pump, not shown, and depressurized fluid is returned to the helm pump from the remaining port. This fluid displacement causes axial movement of the rod 19 which results in corresponding generally axial movement of the link 53, which simultaneously moves the tiller 47 and swivels the motor for steering.

It can be seen that the cup seal 134 essentially prevents leakage of fluid along the piston rod 19 past the outer surface 128 of the end plug 32, and the O-ring seal 152 essentially prevents linkage of fluid passed the open end portion 13 of the body portion 16. Thus the end cap is essentially isolated from pressurized hydraulic fluid, and thus does not weep hydraulic fluid as would otherwise occur if the die cast end cap was exposed to pressurized fluid.

In summary, the invention provides a economical, compact, strong and integrally cast cylinder end caps and associated bosses to which the bracket 14 is securely attached and is prevented from inadvertent shifting. These advantages are attained without incurring problems associated with weeping through porous material commonly encountered with die-cast materials.

ALTERNATIVES

Figure 9:
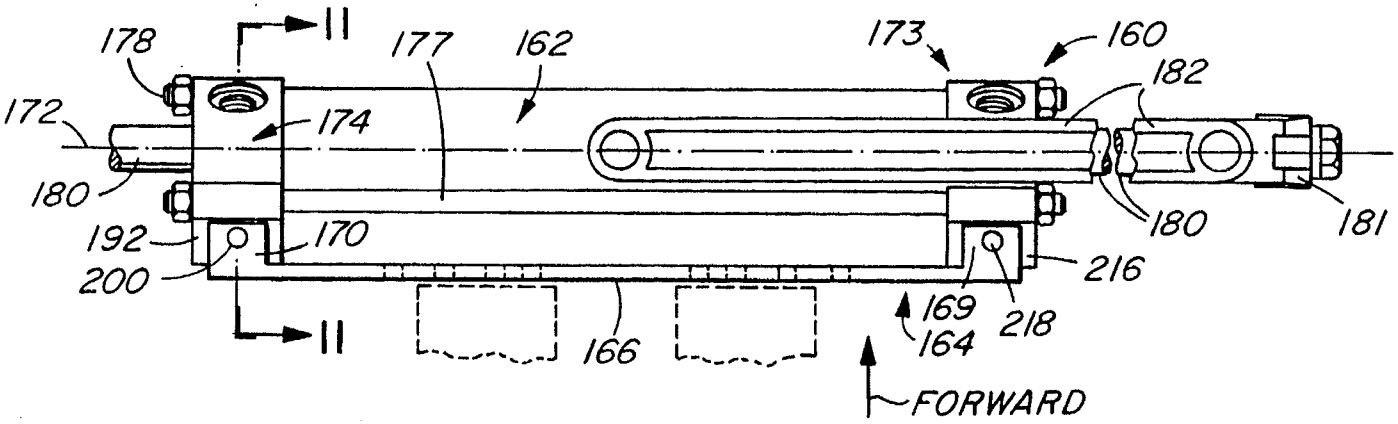
FIG. 9 is a simplified, fragmented top plan of an alternative steering cylinder and mounting bracket assembly according to the invention.
Figure 11:
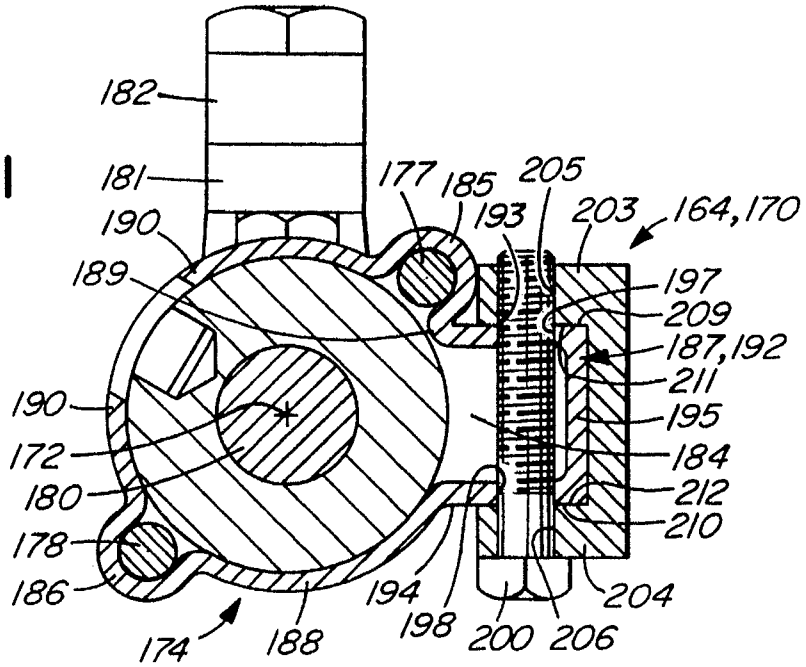
FIG. 11 is a simplified, fragmented cross-section on line 11—11 of FIG. 9, showing cooperation between the alternative steering cylinder and mounting bracket.
Figure 10:
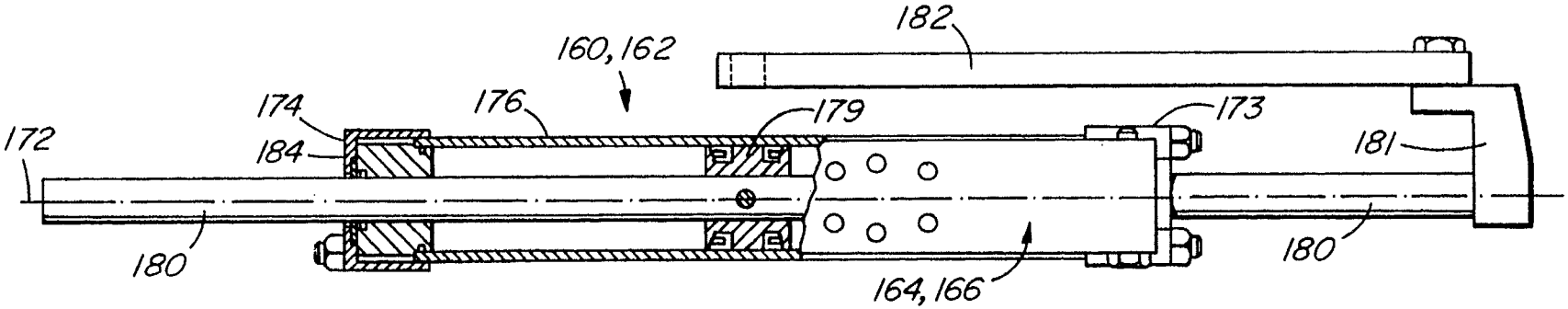
FIG. 10 is a simplified, fragmented rear elevation of the alternative steering cylinder of FIG. 9 as seen looking forward.

FIGS. 9 through 11

An alternative fluid cylinder steering apparatus 160 according to the invention has an alternative fluid steering cylinder 162 and an alternative mounting bracket 164 secured to the outboard motor, not shown, in a manner generally similar to that shown for the mounting bracket 14. Thus, the bracket 164 has a bracket body portion 166 having an array of openings which receive fasteners, not shown, to be secured to the opening 64 in the connectors 65 of the outboard motor, as previously described with reference to FIG. 1. The alternative mounting bracket 164 also has first and second bracket bosses 169 and 170 which are relatively widely spaced apart at opposite ends of the bracket body portion and which cooperate with the cylinder 162 in a different manner from that described with references to FIGS. 1 through 5 as will be described.

The cylinder 162 has a cylinder axis 172, and first and second end caps 173 and 174 which cooperate with undesignated corresponding end plugs and a tubular body portion 176 of the cylinder in a manner similar to that shown in FIGS. 2 through 8. First and second retaining bars 177 and 178 cooperate with the end caps and undesignated nuts to secure the end caps to the body portion as previously described. The cylinder has a piston rod 180 with a piston 179 reciprocable along the axis 172 and a drag link bracket 181 carrying a drag link 182 to connect to the tiller as previously described.

The first and second end caps 173 and 174 are mirror images of each other and thus the second end cap 174 only will be described in detail with reference to FIG. 11 as follows. The end cap 174 is generally similar to the second end cap 22 of FIGS. 1 through 3 and resembles an open-ended cup. The end cup 174 has a generally plane end wall 184 (best seen in FIG. 10), first and second diametrically opposed arcuate wall portions 185 and 186, a U-sectioned wall portion 187, a partially cylindrical wall portion 188, a semi-cylindrical wall portion 190, and a V-shaped wall portion 189. The U-sectioned wall portion 187 is partially square shaped and has generally parallel inner wall portions 193 and 194 and an outer wall portion 195 disposed perpendicularly thereto. Similarly to the first embodiment, the U-sectioned wall portion 187 serves as a cap boss 192 and is adapted to cooperate with the mounting bracket 164 as will be described. It is seen that the wall portions 193, 194 and 195 of the second embodiment are generally similar to the first embodiment wall portions 109, 110 and 111 of FIG. 4, however, in contrast to the first embodiment, the inner wall portions 193 and 194 have aligned fastener clearance openings 197 and 198 respectively passing therethrough to receive a bracket fastener 200 as shown. Also contrasting with the first embodiment, this alternative embodiment does not have an opening in the end wall 184 of the end cap to receive the bracket fastener, and thus the two openings 197 and 198 provide alternative locations for the bracket fastener.

Also, in contrast to the bracket bosses 55 and 56 of FIGS. 1 through 7, the bracket boss 170 comprises a pair of parallel bracket flanges 203 and 204 which are relatively narrowly spaced apart sufficiently to receive the inner wall portions 193 and 194 of the cap bosses 192 therebetween. The flanges 203 and 204 extend generally perpendicularly from the body portion 166 and have aligned fastener openings 205 and 206 passing therethrough which can be aligned with the fastener openings 197 and 198 to receive the bracket fastener 200 passing therethrough as shown. Clearly, the opening 206 is a clearance opening for the fastener, whereas the opening 205 is threaded to cooperate with threads of the fastener as shown so as to secure the fastener 200 within the bracket flanges. Outwardly facing faces of the inner wall portions 193 and 194 serve as mounting faces 209 and 210 of the cap boss 192, and complementary inwardly facing faces of the flanges 203 and 204 serve as mounting faces 211 and 212 of the bracket boss As previously stated, the first end cap 173 is a mirror image of the second end cap 174 and thus has a first cap boss 216 which cooperates with the first bracket boss 169 in a similar manner to the cap boss 192, which is referred to as a second cap boss for consistency. The first bracket boss 169 also has a similar pair of relatively narrowly spaced apart flanges to receive the cap boss 216 therebetween. Thus, the bracket bosses comprise first and second relatively widely spaced apart pairs of flanges extending generally perpendicularly from the bracket body portion. A bracket fastener 218 passes through undesignated aligned openings in the first cap boss 216 and the first bracket boss 169 in a manner similar to that shown in FIG. 11 for the second end cap. It can be seen that the mounting face of each bracket boss, and the complementary mounting face of each cap boss, are within planes disposed generally parallel to the cylinder axis 172. In addition, it can be seen that aligned pairs of fastener openings 197 and 198 of the cap bosses, and aligned pairs of the fastener openings 205 and 206 of the bracket bosses are aligned with each other and disposed perpendicularly to the cylinder axis. Clearly, the pairs of aligned fastener openings of each cap boss and of each bracket boss are disposed parallel to each other and perpendicularly to the cylinder axis.

It can be seen that the bracket bosses 169 and 170 are securely connected to the end caps by a rugged connection with the bracket fasteners, and thus any tendency for loosening between the bracket and the end caps is essentially eliminated. In contrast to the first embodiment, in the alternative embodiment the relative angle between the cylinder 162 and the mounting bracket 164 cannot be adjusted as the angular relationship is determined by the location of the bracket boss and the cap boss. Consequently, the planes containing the mounting faces 209, 210, 211 and 212 are designed to be generally perpendicular to the steering axis 44 of FIG. 1.

The alternative fluid cylinder 162 has corresponding end plugs resilient seals, fluid couplings and other related structure generally similar to that shown for the cylinder 12 of FIGS. 1 through 8 and thus are not described herein.

What is claimed is:

1. A fluid cylinder steering apparatus for mounting on a marine outboard motor for swivelling the motor for steering, the apparatus comprising a steering cylinder which includes:

(a) a tubular body portion having a bore disposed about a cylinder axis, and first and second open end portions, (b) a piston rod and piston reciprocable axially relative to the bore of the body portion, (c) first and second end caps enclosing the first and second open end portions of the body portion respectively, each end cap having a cap boss with a respective cap fastener opening and an axially disposed piston rod opening to receive the piston rod passing therethrough, and (d) retainers cooperating with the end caps to retain the end caps on the body portion, the steering apparatus also comprising a mounting bracket which includes:

(e) a bracket body portion and a pair of bracket bosses extending therefrom, each bracket boss having a respective bracket fastener opening and being located to cooperate with a respective cap boss to form a pair of aligned fastener openings, a boss fastener cooperating with each pair of aligned fastener openings to secure the mounting bracket to the end caps of the steering cylinder, the bracket body portion being adapted to be secured to an outboard motor mount.

2. An apparatus as claimed in claim 1, in which:

(a) each cap boss has at least one mounting face containing the cap fastener opening, and (b) each bracket boss has at least one mounting face containing the respective bracket fastener opening, the mounting face of the bracket boss and the mounting face of the cap boss being generally complementary to each other to provide a secure fit therebetween.

3. An apparatus as claimed in claim 2, in which:

(a) the mounting face of each bracket boss, and the mounting face of each cap boss are within planes disposed generally perpendicularly to the cylinder axis.

4. An apparatus as claimed in claim 2, in which:

(a) the mounting face of each bracket boss, and the mounting face of each cap boss are within a plane disposed generally parallel to the cylinder axis.

5. An apparatus as claimed in claim 1, in which:

(a) the fastener openings of the cap bosses and the bracket bosses are mutually aligned with each other on a boss fastener axis disposed parallel to the cylinder axis.

6. An apparatus as claimed in claim 1, in which:

(a) the fastener openings of the cap boss and the bracket boss of each pair of cap bosses and bracket bosses are disposed parallel to each other and perpendicularly to the cylinder axis.

7. An apparatus as claimed in claim 3, in which:

(a) each cap boss extends laterally and outwardly from the respective end cap, and away from the cylinder axis, and (b) each bracket boss extends laterally from the bracket body portion and towards the cylinder axis.

8. An apparatus as claimed in claim 7, in which:

(a) axial spacing between the mounting faces of the bracket bosses is less than the axial spacing between mounting faces of the cap bosses to permit the mounting bracket to be interposed between the end caps.

9. An apparatus as claimed in claim 1, in which:

(a) the bracket body portion has an array of openings therein.

10. An apparatus as claimed in claim 1, in which:

(a) the bracket portion is a flat elongated plate having an array of openings therein, and (b) the bracket bosses comprise first and second relatively widely spaced apart flanges extending generally perpendicularly from the bracket body portion.

11. An apparatus as claimed in claim 1, in which:

(a) the bracket body portion is a flat elongated plate having an array of openings therein, and (b) the bracket bosses comprise first and second relatively widely spaced apart pairs of flanges extending generally perpendicularly from the bracket body portion, each pair of flanges being relatively narrowly spaced apart by a gap sufficient to receive the cap bosses therebetween.

12. An apparatus as claimed in claim 1, in which the retainers comprise:

(a) each end cap having at least one pair of bar openings, the bar openings of each end cap being disposed on generally opposite sides of said end cap, the bar openings of the first end cap being aligned with corresponding bar openings of the second end cap, and (b) at least one pair of axially disposed retaining bars disposed parallel to the tubular body portion, each bar having respective first and second end portions passing through the aligned bar openings of the first and second end caps respectively to retain the caps on the end portions of the tubular body portion.

13. An apparatus as claimed in claim 12, in which:

(a) each end cap has bar embracers to embrace end portions of the bars on opposite sides of the tubular body portion, so that a particular portion of each bar passes closely between the end cap and the body portion, and (b) each bar embracer is adjacent and aligned with a respective bar opening at each end cap.

14. An apparatus as claimed in claim 13, in which:

(a) each bar embracer comprises an arcuate wall portion which is complementary to the end portion of the respective bar, the bar embracers of each end cap being diametrically opposed to each other.

15. An apparatus as claimed in claim 1 in which the end cap resembles an open-ended cup and comprises:

(a) a semi-cylindrical wall portion, (b) a partially-cylindrical wall portion, (c) a generally U-sectioned wall portion, (d) diametrically opposed, first and second arcuate wall portions, the wall portions being interconnected to form a continuous periphery to enclose the body portion, and (e) a generally plane end wall portion which is integral with coplanar outer edge portions of the said wall portions.

16. An apparatus as claimed in claim 15, in which the retainers comprise:

(a) at least one pair of axially disposed retaining bars disposed parallel to the tubular body portion, each retaining bar having respective first and second end portions cooperating with the first and second end caps respectively to retain the caps on the end portions of the tubular body portion, and (b) the diametrically opposed, first and second arcuate wall portions of each end cap are complementary to the said end portions of the bars to enclose the bars therein to serve as bar embracers to retain the respective end portion of the bars within the end caps, and (c) the end wall portion of each end cap has diametrically opposed bar openings therein adjacent the first and second arcuate wall portions to receive the respective end portions of the bars.

17. An apparatus as claimed in claim 1, further comprising:

(a) first and second end plugs sealingly engaging the first and second open end portions respectively of the body portion, the first and second end plugs being partially enclosed by the first and second end caps respectively and being of a non-porous material, each end plug having a piston rod opening therein to receive the piston rod passing therethrough, each rod opening being aligned with the respective axially disposed piston opening of the respective end cap and being sealed against the piston rod to prevent fluid leaking therefrom.

18. An apparatus as claimed in claim 17, further characterised by:

(a) each end plug having an annular outer surface containing a seal groove extending around the rod opening, and (b) an annular seal fitted in the seal groove and sealably engaging the rod.

19. An apparatus as claimed in claim 18, in which:

(a) the annular outer surface of each end plug being generally flat and disposed perpendicularly to the cylinder axis, the seal groove being in the said outer surface, and (b) a flat washer having a clearance opening to receive the piston rod passing therethrough, the washer having an inner surface engaging the annular seal and the outer surface of the respective end plug, and an outer surface engaged by the respective end cap.

20. An apparatus as claimed in claim 1, in which:

(a) each end plug has an inner face facing into the bore of the body portion, a transfer conduit communicating with the bore of the body portion, and a radial opening extending inwardly from a cylindrical surface of the end plug and communicating with the transfer conduit, and (b) an end cap associated with the said one end plug has a transverse opening passing therethrough aligned with the radial opening of the said one end plug to communicate with a fluid conduit to conduct fluid between the fluid conduit and the bore of the body portion.

* * * * *